US009227130B1

(12) United States Patent
Burdick

(10) Patent No.: US 9,227,130 B1
(45) Date of Patent: Jan. 5, 2016

(54) TENNIS TRAINING DEVICE

(71) Applicant: Joshua Burdick, New York, NY (US)

(72) Inventor: Joshua Burdick, New York, NY (US)

( * ) Notice: Subject to any disclaimer, the term of this patent is extended or adjusted under 35 U.S.C. 154(b) by 0 days.

(21) Appl. No.: 14/690,664

(22) Filed: Apr. 20, 2015

(51) Int. Cl.
*A63B 69/38* (2006.01)

(52) U.S. Cl.
CPC ..... *A63B 69/385* (2013.01)

(58) Field of Classification Search
CPC ..... A64B 69/38; A64B 69/385; A64B 69/36; A64B 69/3641
USPC ..... 473/459, 461, 463, 257–260
See application file for complete search history.

(56) References Cited

U.S. PATENT DOCUMENTS

| | | | | |
|---|---|---|---|---|
| 1,567,530 | A | 12/1925 | MacNaughton et al. | |
| 3,711,103 | A | 1/1973 | Seltzer | |
| 4,105,204 | A * | 8/1978 | Koenig | A63B 69/38 473/461 |
| 4,163,552 | A | 8/1979 | Tiso | |
| 5,072,942 | A | 12/1991 | Hurley | |
| 5,312,107 | A | 5/1994 | Gvoich et al. | |
| 5,439,225 | A | 8/1995 | Gvoich et al. | |
| 5,441,255 | A | 8/1995 | Verbick | |
| 6,056,653 | A * | 5/2000 | Boldin | A63B 69/38 473/461 |
| 8,602,922 | B2 | 12/2013 | Schwenger et al. | |
| 8,715,098 | B2 | 5/2014 | Napolitano et al. | |
| 2003/0153411 | A1 * | 8/2003 | Obidiegwu | A63B 69/38 473/461 |
| 2005/0176519 | A1 * | 8/2005 | Elkins | A63B 69/3632 473/258 |
| 2014/0011602 | A1 * | 1/2014 | Zimmerman, II | A63B 69/3644 473/259 |

* cited by examiner

*Primary Examiner* — Raleigh W Chiu
(74) *Attorney, Agent, or Firm* — Buchanan Ingersoll & Rooney PC

(57) ABSTRACT

In a tennis training device there is a curved track whose curvature corresponds to the correct path that a tennis racquet should travel during a proper serve. The track has a channel along its length. The channel is sized and configured to receive a coupling which is attached to the head of a tennis racquet. The coupling travels along the track and allows the head of the tennis racquet to rotate relative to the track. The tennis racquet coupling preferably is a clip configured for releasable attachment to a head of a tennis racquet and a connector having an elongated body and a head attached to the body.

17 Claims, 3 Drawing Sheets

TENNIS TRAINING DEVICE

FIELD OF INVENTION

The invention relates to a device for teaching tennis players how to improve their game.

BACKGROUND OF THE INVENTION

A tennis player seeking to improve his or her game may hire an instructor who observes the player and then informs him or her orally whether or not he or she has executed the serve or other forehand stroke or backhand stroke properly. The instructor may then show the player the correct way to execute the stroke. An advantage of this type of practice is that the player receives individual attention from the instructor during the time period that the instructor is with the player. On the other hand this mode of practicing can be quite expensive and must be scheduled in advance at a time when both the instructor and the player are available.

The art has developed a number of training devices that a player can use without an instructor at a time and place that is convenient to the player. Many of these training devices employ sensors on the tennis racquet to detect movement of the tennis racquet and ball strikes. For example U.S. Pat. No. 4,163,552 discloses an apparatus for facilitating the practice of tennis which has a housing that is attached to the neck of the tennis racquet. An elastic band is connected between the housing and a pole to limit movement of the tennis racquet during the swing and help define a path of travel. Sensors and bells are provided on the housing to indicate when the racquet reaches certain points in the path of travel.

U.S. Pat. No. 8,602,922 B2 discloses a method and apparatuses for enhancing performance in racquet sports. One or more sensors are provided on the tennis racquet. The sensor may be one or more accelerometers used to measure acceleration associated with racquet movement. An anemometer can be used to sense air speed relative to the racquet. A pressure sensor may be provided to measure tension on the strings or to measure the pressure exerted by the user on the handle while gripping the racquet. A strain gauge sensor may be provided to sense the strain applied to the strings or to sense the impact forces generated when a ball impacts against the strings. Piezoelectric sensors may be provided to identify locations where the ball strikes the racquet. A skin sensor may be provided on the grip to sense the player's heart rate. The sensors are connected to a processor on the racquet or remote from the racquet.

U.S. Pat. No. 5,757,266 discloses an electronic apparatus for providing player performance feedback in which sensors are provided on the racquet to indicate impact locations where a ball strikes the racquet.

While these devices can be helpful training aids, they can be expensive and require a power source. Furthermore, the sensors, bells and hardware used to attach them add weight to the tennis racquet and may change the center of gravity of the racquet. That weight is not present when the player plays a tennis match. Having added weight on the racquet makes the training conditions significantly different than the conditions that are encountered during play.

There is a need for a tennis training device that does not add much weight to the tennis racquet. This training device should be portable and more closely simulate playing conditions than the training devices that attach sensors to the tennis racquet.

SUMMARY OF THE INVENTION

I provide a curved track whose curvature corresponds to the correct path that a tennis racquet should travel during a proper serve or used in horizontal position to the ground to teach tennis players how to keep full arm extension when striking a tennis ball. The track has a channel along its length. The channel is sized and configured to receive a coupling which is attached to the head of a tennis racquet and permit the coupling to travel along the track. The tennis racquet coupling preferably is a clip configured for releasable attachment to a head of a tennis racquet and a connector having an elongated body and a head attached to the body. The clip must be able to rotate relative to the track when in use. In one embodiment the connector is T-shaped and is attached to the clip in a manner so that the clip can rotate around a longitudinal axis through the elongated body of the T-shaped connector. In another embodiment the head is spherical. The head of the connector is sized to fit within the channel of the track.

I prefer to provide a support bracket connected to the track for attaching the track to a vertical surface. That vertical surface may be a wall or a post.

I further prefer to provide a protrusion on the each opposite inside surface of the U-shaped clip. The protrusions are preferably made of a flexible material and help keep the clip on the racquet during use.

The track preferably is plastic and may be made in sections that fit together to form the desired curvature. The track could be somewhat flexible so that the user could change the curvature. Alternatively, interchangeable track segments having different curvature may be provided to enable the user to construct tracks of different curvature.

Other objects and advantages of the present training device will become apparent form a description of certain present preferred embodiments shown in the drawings.

DESCRIPTION OF THE PREFERRED EMBODIMENTS

Figure 1:
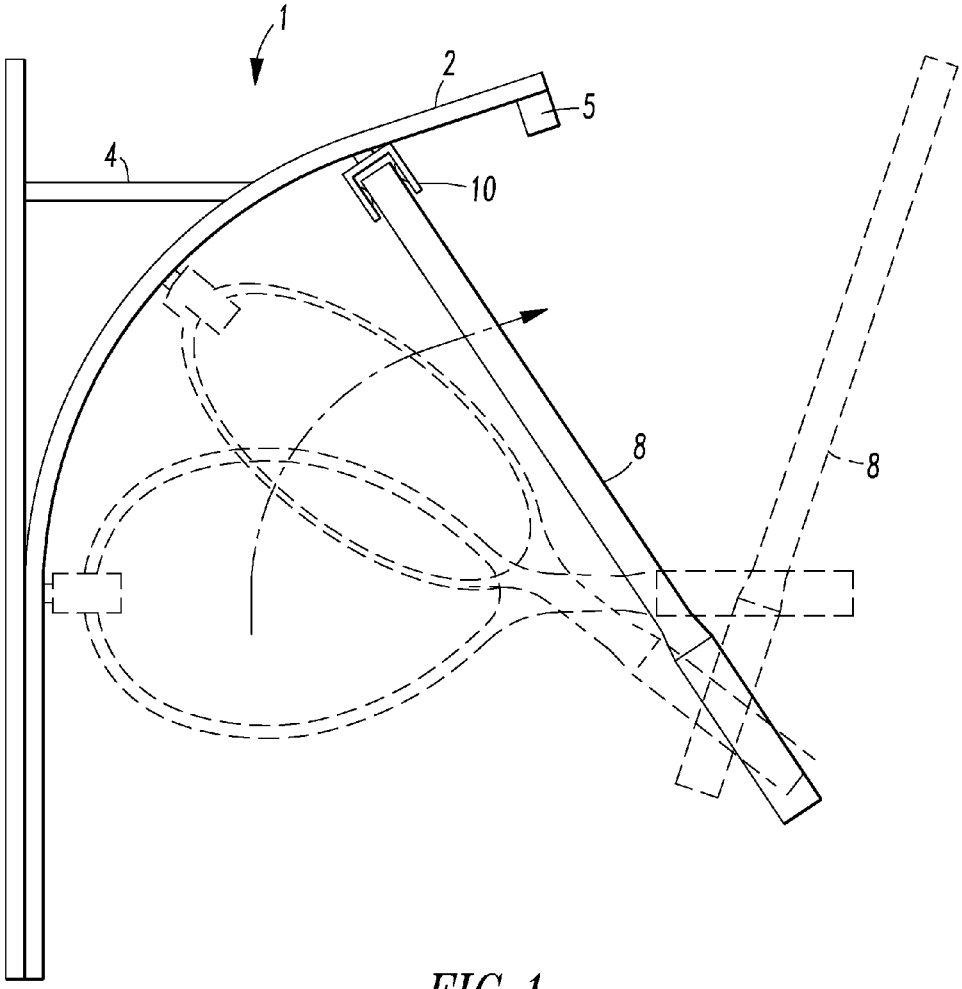
FIG. 1 is a side view of a present preferred embodiment of my tennis training device with a tennis racquet shown in selected positions to illustrate use.
Figure 2:
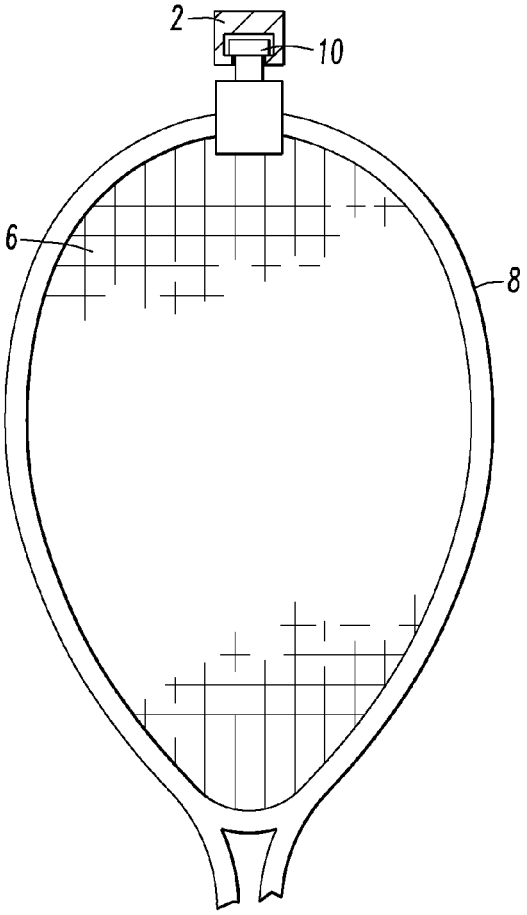
FIG. 2 is a front view of the tennis racquet coupling within the track of the embodiment shown in FIG. 1, the coupling being attached to the head of a tennis racquet.

A tennis training device 1 has a curved track 2 having a channel 3 along its length. The track has a curvature corresponding to a path of a swing of a tennis racquet. Preferably the path corresponds to the path that a tennis racquet travels when the user is correctly serving. However, the track could be configured to correspond to other paths that a tennis racquet may travel during a tennis match. A bracket 4 is provided for attaching the track to a vertical surface such as a wall or post. A glide stop 5 is provided on the end of the track.

A tennis racquet coupling 10 has a clip 12 configured for releasable attachment to a head 6 of a tennis racquet 8. A connector 14 is attached to the clip. The head 16 of the connector 14 fits within and travels along the channel. The clip must be able to rotate relative to the track when in use. In the embodiment shown in FIGS. 3 and 4 the connector 14 is T-shaped and is attached to the clip 12 in a manner so that the clip can rotate around a longitudinal axis through the elongated body 15 of the T-shaped connector. I prefer to provide ball bearings 18 on the head. In the embodiment of FIG. 5 I provide a different coupling 20 having a spherical head 26 on the connector 24. The spherical head 26 enables the coupling 20 to rotate with respect to the track. If a spherical head is provided then the elongated body would not need to rotate relative to the clip.

Figure 3:
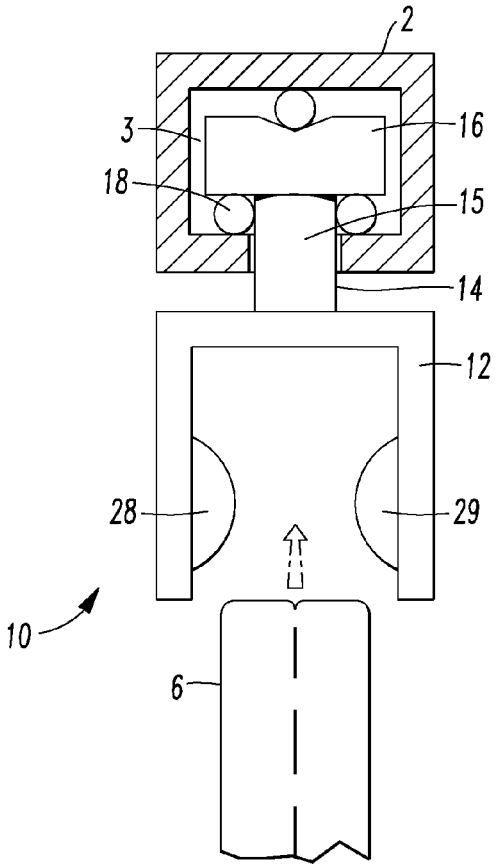
FIG. 3 is a side view of the tennis racquet coupling with a portion of the head of a tennis racquet, the coupling having been rotated 90° from its position in FIG. 2.
Figure 4:
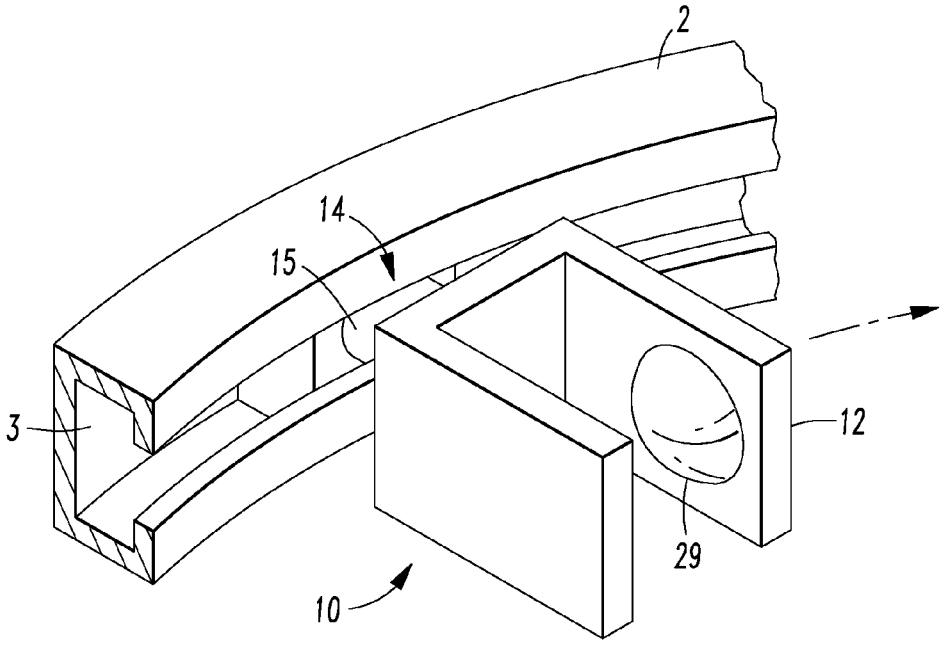
FIG. 4 is a perspective view of the tennis racquet coupling within the track.
Figure 5:
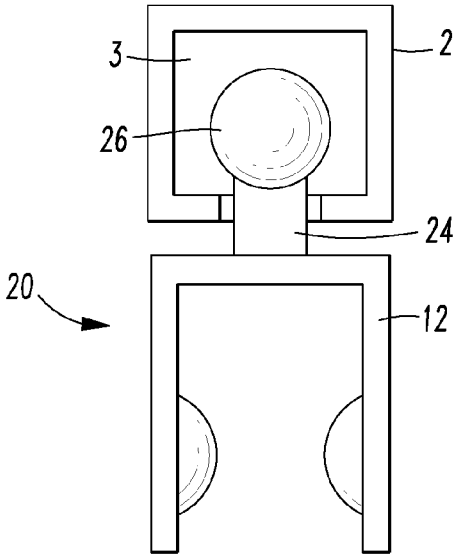
FIG. 5 is a side view of an alternative embodiment of the tennis racquet coupling that can be used in the tennis training device.

As can be seen in FIGS. 3 and 4 I provide protrusions 28 and 29 on the opposite inside surfaces of the clip 10. The protrusions are preferably made of a flexible material such as rubber and help keep the clip on the racquet during the swing while allowing the racquet to be pulled out of the clip when the racquet reaches the end of the track. Once the clip 10 holding the tennis racquet hits the glide stop 5, the force of the tennis racquet will depress the flexible protrusions which hold the racquet on the connector place. The insert pressure required for the racquet head to fit into the glide clip preferably is less than three pounds and the force required to release the racquet head from the glide clip must be greater than three pounds which is developed by the inertia of the swing.

Clip 12 can be metal or plastic and preferably is made as one piece. The flexible protrusions can be attached to the clip by an adhesive or a mechanical connection. Alternatively, the clip and protrusions could be co-injection molded. It is also possible to make the clip in two or more pieces that are permanently or releasably connected together.

The track preferably is plastic and may be made in sections that fit together to form the desired curvature. Suitable plastics include polypropylene, calcium-filled polypropylene or talc-filled polypropylene. The track could be somewhat flexible so that the user could change the curvature. Alternatively, interchangeable track segments having different curvature may be provided to enable the user to construct tracks of different curvature.

Although I have described and illustrated certain present preferred embodiments of my tennis training device, it should be distinctly understood that my invention is not limited thereto but may be variously embodied within the scope of the following claims.

I claim:

1. A tennis training device comprising:

a tennis racquet coupling comprised of a clip configured for releasable attachment to a head of a tennis racquet, and a connector having an elongated body and a head attached to the body, the elongated body connected to the clip in a manner so that the clip can rotate around a longitudinal axis through the elongated body;

a curved track having a channel along its length, the channel sized and configured to receive the head of the racquet coupling and permit the coupling to travel along the track, the track having a curvature corresponding to a path of a swing of a tennis racquet; and a support bracket connected to the track for attaching the track to a vertical surface.

2. The tennis training device of claim 1 wherein the path corresponds to a desired motion of a tennis racquet when serving a tennis ball.

3. The tennis training device of claim 1 wherein the clip is comprised of a U-shaped body.

4. The tennis training device of claim 3 also comprising at least one flexible protrusion on an inside surface of the clip.

5. The tennis training device of claim 4 wherein the at least one flexible protrusion is rubber.

6. The tennis training device of claim 1 also comprising at least one bearing on the head, the at least one bearing engaging the track.

7. The tennis training device of claim 1 wherein at least one of the clip, the connector, the track and the bracket are plastic.

8. The tennis training device of claim 7 wherein the plastic is polypropylene, calcium-filled polypropylene or talc-filled polypropylene.

9. The tennis training device of claim 1 wherein the track is comprised of a metal extrusion.

10. A tennis training device comprising:

a tennis racquet coupling comprised of a clip configured for releasable attachment to a head of a tennis racquet, and a connector having an elongated body and a spherical head attached to the body, the elongated body connected to the clip;

a curved track having a channel along its length, the channel sized and configured to receive the head of the racquet coupling, allow the head of the racquet coupling to rotate within the channel and permit the coupling to travel along the track, the track having a curvature corresponding to a path of a swing of a tennis racquet; and a support bracket connected to the track for attaching the track to a vertical surface.

11. The tennis training device of claim 10 wherein the path corresponds to a desired motion of a tennis racquet when serving a tennis ball.

12. The tennis training device of claim 10 wherein the clip is comprised of a U-shaped body.

13. The tennis training device of claim 12 also comprising at least one flexible protrusion on an inside surface of the clip.

14. The tennis training device of claim 13 wherein the at least one flexible protrusion is rubber.

15. The tennis training device of claim 10 wherein at least one of the clip, the connector, the track and the bracket are plastic.

16. The tennis training device of claim 15 wherein the plastic is polypropylene, calcium-filled polypropylene or talc-filled polypropylene.

17. The tennis training device of claim 10 wherein the track is comprised of a metal extrusion.

* * * * *